United States Patent [19]

Pfuhl et al.

[11] Patent Number: 4,890,647

[45] Date of Patent: Jan. 2, 1990

[54] HYDRAULIC CONTROL VALVE

[75] Inventors: Berthold Pfuhl, Markgröningen; Volkmar Leutner, Friolzheim; Eckard Schuttenberg, Stuttgart, all of Fed. Rep. of Germany

[73] Assignee: Robert Bosch GmbH, Stuttgart, Fed. Rep. of Germany

[21] Appl. No.: 252,441

[22] Filed: Sep. 30, 1988

[30] Foreign Application Priority Data

Nov. 4, 1987 [DE] Fed. Rep. of Germany ..... 3737392

[51] Int. Cl.[4] ..... F15B 13/042

[52] U.S. Cl. ..... 137/625.66; 137/625.69; 251/324; 251/337

[58] Field of Search ..... 137/625.66, 625.69; 251/324, 337

[56] References Cited

U.S. PATENT DOCUMENTS 3,771,564 11/1973 Bianchetta et al. ..... 137/625.63
4,133,510 1/1979 Lorimar ..... 137/625.66 X
4,205,592 6/1980 Haüssler .
4,238,112 12/1980 Derozier ..... 137/625.69 X
4,434,966 3/1984 Zajac ..... 137/625.66 X

FOREIGN PATENT DOCUMENTS 2031584 12/1971 Fed. Rep. of Germany .

*Primary Examiner*—Gerald A. Michalsky
*Attorney, Agent, or Firm*—Michael J. Striker

[57] ABSTRACT

A hydraulic control valve comprises a housing having a slider opening and at least two pressure medium chambers, a control member which is longitudinally movable in the opening so as to at least control a communication between the two pressure medium chambers, the control member having two opposite ends, a rotation preventing element provided on one of the ends of the control member, a coupling part which is arranged on the control member non-rotatably and longitudinally displaceably relative to the latter, and a structural member which is arranged radially to the control member so as to guide the coupling part longitudinally displaceably and non-rotatable relative to the housing.

8 Claims, 3 Drawing Sheets

HYDRAULIC CONTROL VALVE

BACKGROUND OF THE INVENTION

The present invention relates to a hydraulic control valve with a control member which is longitudinally displaceable in a longitudinal opening of a housing.

Hydraulic control valves of the above mentioned general type are widely known in the art. One of such hydraulic control valves is formed as a two-step, continuously operating 4/3-directional proportional valve, and its hydraulically actuatable main control slider which serves as a control member is provided with a rotation preventing element. For this purpose, parallel pins are fixedly arranged in the housing and extend in the axial movement direction of the main control sleeve. Both pins are pressed with their end in the housing cover, while the other free end extends in an end-side opening of the main control slider. With this rotation preventing element the diameter of both pins is limited since the end-side piston portion of the main control slider in addition to the guiding openings for the pins, also must receive a head-shaped spring plate, in which additionally the spring for a double-acting return device of the main control slider extends. Moreover, the spring plates must be provided with throughgoing openings for both pins. This rotation preventing element has the disadvantage that it is relatively expensive and also it is subjected to high mechanical loads. The power take-up through axially arranged pins permits the transmission of low moments which during the operation of such valve within the limited region are frequently exceeded. Further, in this rotation preventing element the pins are subjected to different bending loads, depending on the respective position of the slider. In addition, in this torsion safety element the pins must be exactly aligned with the guiding openings for avoiding any interference with the movability of the control slider.

The German document DE-OS 2,031,584 discloses a hydraulic current regulator which has a longitudinally movable control member secured against turning by a longitudinal pin which extends eccentrically to the longitudinal axis. This current regulator deals primarily with a position securing of the control member so as to provide that the control openings in the longitudinally movable control member are guided relative to the housing-fixed control openings always in the same turning position. Also, this rotation preventing element has substantially the same disadvantages as the above described rotation preventing element with axial force take up and is not suitable for directional valves which have control sliders deflectable in different working positions against a double-acting return unit.

The German document DE-OS 2,658,928 shows in FIG. 7*a* a hydraulic volume stream sensor with a control member which is deflectable from a spring-centered central position to both sides in working positions. For facilitating the pick-up of an electrical control signal, the longitudinally movable control member is secured against torsion with the help of an eccentric pin which is arranged in the longitudinal direction of the control member in a housing-fixed opening. This rotation preventing element is not suitable for transmitting high moments.

SUMMARY OF THE INVENTION

Accordingly, it is an object of the present invention to provide a hydraulic control valve of the above mentioned general type which avoids the disadvantages of the prior art.

More particularly, it is an object of the present invention to provide a hydraulic control valve which has a simple and inexpensive rotation preventing element which can withstand high loads.

In keeping with these objects and with others which will become apparent hereinafter, one feature of the present invention resides, briefly stated, in that a coupling part is arranged on the control member non-rotatably and longitudinally displaceably relative to the latter, and the coupling part is guided by a structural part in a longitudinally displaceable and non-rotatable manner relative to the housing.

When the hydraulic control valve is designed in accordance with the present invention it achieves the above specified objects.

The rotation preventing element is simple and inexpensive, and it withstands high loads. Also in the event of high number of load variations no breakages occur in the structural elements of the rotation preventing element. The rotation preventing element is suitable especially for control valves which are used within a limited region and thereby operate with maximum throughflow currents and high pressure difference, as takes place especially during a single-acting throughflow. It can transfer torques from the control slider to the housing, which are produced by the current forces which occur on the control notches of the control slider. The inventive torsion safety element has the advantage that with its parts the bending resistance is independent from the respective position of the longitudinally movable control member and is always the same. In addition, the radial power take-up in the rotation preventing element is favorable since with relatively small structural elements it provides the transmission of higher torques. When there is a higher operational distance which is determined from the outer diameter of the coupling part, the transferring operative force is smaller. Moreover, with the radially arranged structural element there is a short bending length, whereby small bending stresses occur and therefore the structural element can be formed with small dimensions. Moreover, the principle of spring centering of the main control slider in its initial position remains unchanged with the proposed rotation preventing element. Finally, a favorable mounting length of the control slider relative to the pressure medium chambers or channels of the housing is obtained, so that the throughflow fluctuation are retained low.

In accordance with another advantageous feature of the present invention, the coupling part is formed as a spring plate of a deterrent device associated with the control member. The rotation preventing element in the control valve is here formed in an especially place-saving and cost-favorable manner, since available structural part of a spring plate performs an additional function.

The coupling part can be formed as a one-piece integral member composed of a sleeve-shaped tubular part with a stepped throughgoing opening having an end side opening of a smaller diameter and two cuts forming two projections, and an inner portion with a greater diameter for guiding on the control member. These features provide for a very simple and cost-favorable construction and manufacture of the coupling part.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
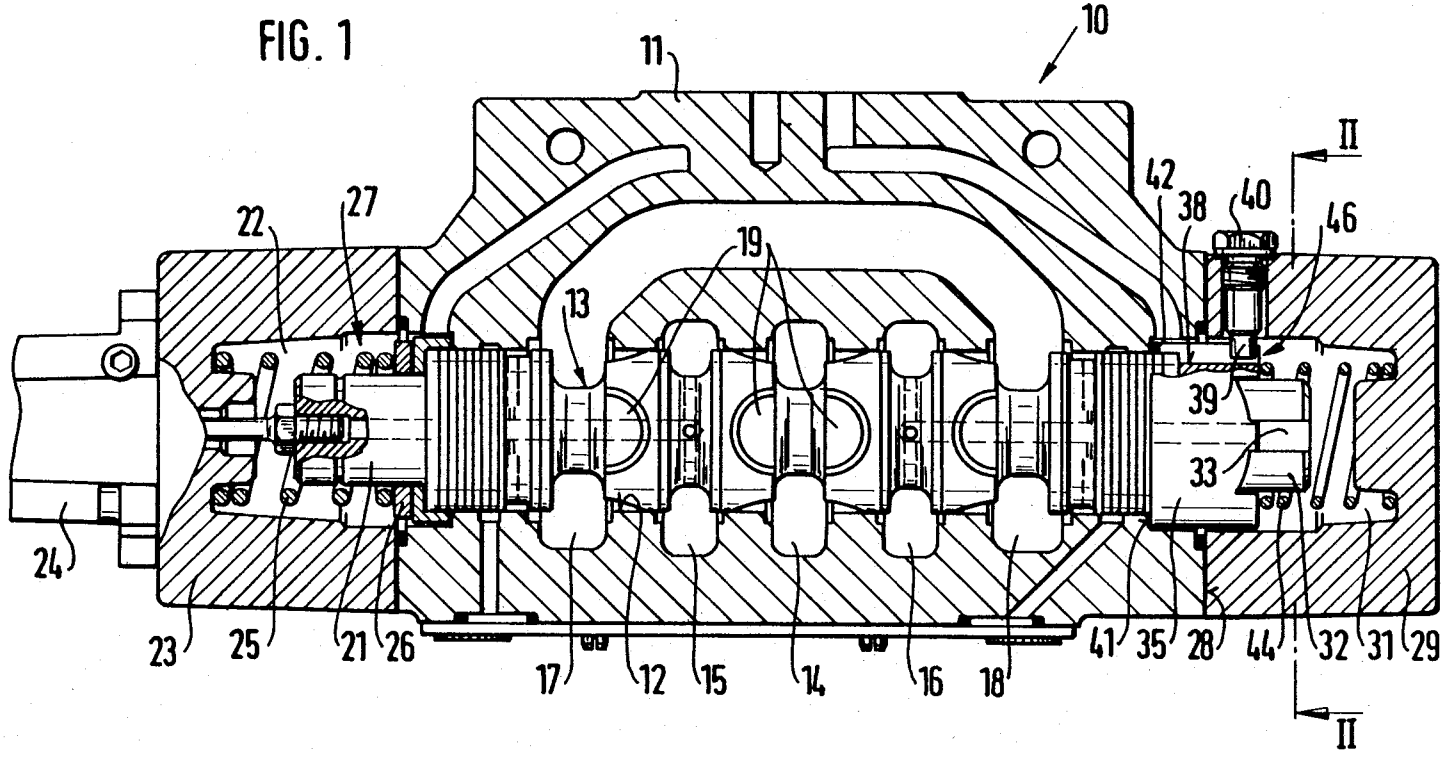
FIG. 1 is a view showing a longitudinal section of the hydraulic control valve in accordance with the present invention.

FIG. 1 shows a hydraulic control valve 10 which is formed a second step of an electrohydraulically precontrolled, continuously operating proportional directional valve in an embodiment of 4/3-valve, wherein for the sake of simplicity the pre-control step is not shown.

The control valve 10 has a housing 11 provided with a throughgoing slider opening 12. A main control slider 13 which forms a longitudinally movable control member is slidingly guided in the slider opening 12. The slider opening 12 has a conventional supply chamber 14, a first and second consumer chamber 15 and 16, and outwardly located first return chamber 17 and second return chamber 18. The return chambers are in communication with one another. For controlling the conventional communications between the chambers 14–18, the main control slider 13 is provided with special control notches 19 which permit a fine adjustment.

The main slider 13 extends with its left, piston-shaped end portion 21 into a first pressure chamber 22 which is limited by a first housing cover 23. The housing cover 23 is mounted on the housing 11 and in addition carries an outwardly mounted displacement pickup 24. The first pressure chamber 22 accommodates a first spring 25 and an associated spring plate 26 which form a part of a double-acting return device 27. The latter centers the main control slider 13 to its shown central position.

The housing 11 is closed on its other end side 28 by a second housing cover 29. This housing cover forms in its interior a second pressure chamber 31. An end side piston portion 32 of the main slider 13 extends into the pressure chamber 31. The piston portion 32 has a diameter which is smaller than the outer diameter of the control slider 13.

Figure 2:
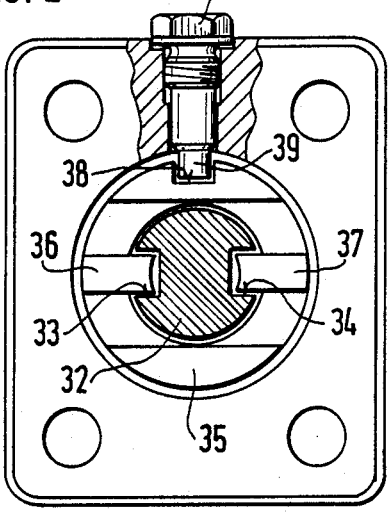
FIG. 2 is a view showing a section taken along the line II—II in FIG. 1 on an enlarged scale.

As can be seen in FIG. 1 in connection with FIG. 2, two longitudinal grooves 33 and 34 are formed outside on the piston portion 32. A one-piece formed coupling part 35 is radially guided on the piston portion 32 and is arranged movably in the longitudinal direction of the main control slider 13. As seen in particular from FIG. 2, the coupling part 35 engages with two projections 36 and 37 in the longitudinal grooves 33 and 34 so that it is longitudinally movable relative to the main slider 13 in a longitudinal direction but is prevented from rotation relative to the main control slider.

Figure 3:
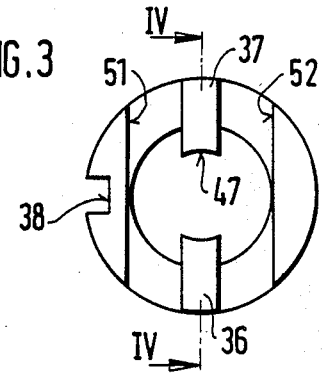
FIG. 3 is a front view of a coupling part of a rotation preventing element of FIG. 2 with the coupling part assuming a different rotary position.

As can be seen from FIG. 1 in connection with FIGS. 2 and 3, the coupling part 35 is provided on its outer periphery with a longitudinal groove 38 which is offset relative to the projections 36 and 37 by 90°. A matching pin 39 of a collar screw 40 which is inserted in the second housing cover 29 radially to the main control slider 13, engages in the longitudinal groove 38. The coupling part 35 is supported with its inner end surface 41 against a stationary abutment 42 mounted in the housing 11. A second spring 44 abuts against the opposite end of the surface 43. The spring 44 together with the coupling part 35 is arranged in the second pressure chamber 31 and simultaneously forms a part of a double-acting return device 27.

Figure 4:
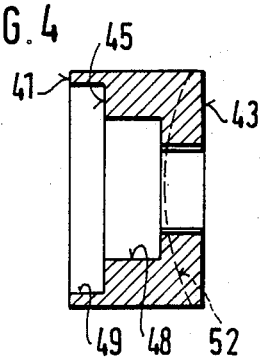
FIG. 4 is a longitudinal section taken along the line IV—IV in FIG. 3.

As can be seen from FIG. 1 in connection with FIG. 4, the coupling part 35 has an inner shoulder 45, with which the coupling part 35 abuts against the control slider 13 at least in the neutral position shown in FIG. 1. The coupling part 35 which is fixed against rotation is longitudinally displaceable on the piston portion 32 thereby takes over the function of the second spring part for the double-acting return device 27. Simultaneously the coupling part 35 together with the collar screw 40 forms a rotation-preventing safety element 46 for the longitudinally movable main control slider 13.

Figure 5:
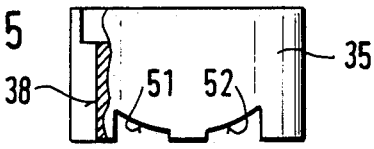
FIG. 5 is a plan view of the coupling part of FIG. 3 of the inventive hydraulic control valve.

As shown in FIGS. 3–5, the one-piece coupling part 36 can be produced especially easy. Its production can start from a sleeve-shaped material with an inner diameter 47 which is determined by the projections 36 and 37. The diameter of a central opening portion 47 is selected so that the coupling part 35 can be reliably radially guided on the piston portion 32. With the help of an outer opening portion 49, an inner shoulder 45 for abutment of the main control slider 13 is produced. In the initial material which has the above mentioned opening portions 48 and 49 two parallel plunge-millings 51 and 52 can form this part so that the material region wich is provided with an inner diameter 47 remains to form both projections 36 and 37. The radius of one of the plunge-millings 51 is shown in FIG. 4 with a broken line.

The basic function of such a proportional directional valve is known. The operation of the hydraulic control valve 10 will be now explained in detail.

When the control valve 10 is set in a limiting region, the main control slider 13 processes maximum throughflow stream at high pressure difference. There can be cases when in the control valve 10 only a single flow occurs, or in other words, when for example a pressure medium stream flows only from the supply chamber 14 through the control notch 19 into the first consumer chamber 15, while a correspondingly greater return stream through the main control slider 13 does not occur. Such a single throughflow can take place especially when the control valve 10 is utilized in a accumulator circuit. Exactly during the operation in these limiting regions the pressure medium stream which flows over the control notch 19 can cause flow forces which can displace the main control slider 13 in rotation. Such a rotation of the main control slider 13 can lead to its fixation or adhesion in the housing 11 and thereby to an operational failure. For preventing this, the main control slider 13 is associated with the element 46 for preventing the rotation.

The torque applied by the main control slider 13 is transmitted to the coupling part 35 through the longitudinal grooves 33, 34 which are formed on the piston portion 32 and through the projection 36 and 37 which engage in the longitudinal grooves. The coupling part 35 in turn abuts in a rotation-fixed manner on the housing 11 through the outer longitudinal groove 38 and the collar screw 40.

A longitudinal movement of the main control slider 13 from its shown neutral position to the left, whereby it connects the supply chamber 14 with the first consumer chamber 15, the second consumer chamber 16, the second return chamber 18, is made possible by the longitudinal grooves 33 and 34 in the piston portion 32, in which the projections 36 and 37 of the housing fixed coupling part 35 slide. During this longitudinal movement of the main control slider 13 the coupling part 35 which is loaded by the spring 44 is supported with its inner end surface 41 against the housing-fixed abutment 42.

When the main control slider 13 moves from the shown neutral position to the right, whereby it connects the supply chamber 14 with the second consumer chamber 16, then the coupling part 35 with its inner shoulder 45 which abuts against the main control slider 13 is taken along against the force of the second spring 44. This longitudinal movement is possible by the outer longitudinal groove 35 in which the collar screw 40 engages with its pin 39. The spring-loaded coupling part 35 lifts therefore from the housing-fixed abutment 42 and takes over simultaneously the function of a spring plate in a double-acting return device 27.

With the utilization of a single coupling part 35 for both functions of the rotation preventing element and spring plate element, a place economical and cost favorable construction is obtained in an advantageous manner, which is suitable for post-equipping of the available proportional valves. With the rotation preventing element 46, the bending load of its parts is always of the same value and independent of whether the main control slider 13 deviates from its neutral position to the left or to the right to the working positions. The radial take-up of the torque from the main control slider 13 through the rotation preventing element 46 provides a favorable design of its structural elements as at an axial moment takeup, so that with relatively small parts relatively high torques can be transmitted. With the rotation preventing element 46 a relatively high operative distance for the force to be transmitted to the collar screw 40 is obtained since the outer diameter of the coupling part 35 is greater than the outer diameter of the main control slider 13. In addition, the bending length in the collar screw 40 is very short since it can be arranged immediately adjacent to the outer longitudinal groove 38 in the second housing cover 29 so that only relatively small bending stresses occur. It is especially favorable that the spring plate function can be integrated directly into the coupling part 35 so that the principle of the spring-centered neutral position of the main control slider 13 can be maintained. Moreover, the coupling part 35 can be produced as a one-piece structural part in a simple and cost-favorable manner.

Figure 6:
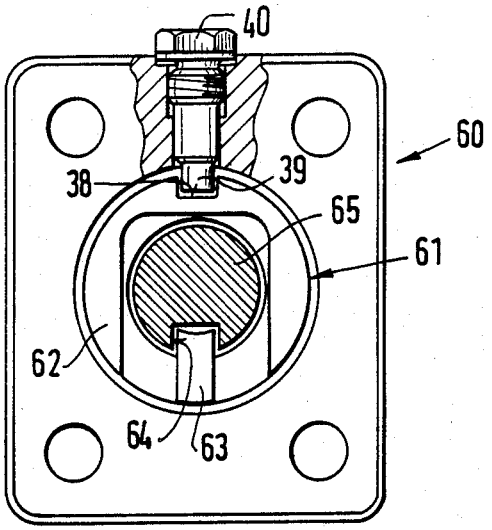
FIG. 6 is a view showing a section corresponding to FIG. 2 through a further embodiment of the hydraulic control valve with a different rotation preventing element.

FIG. 6 shows a cross-section which corresponds to FIG. 2 through a second control valve 60 which has a second torsion safety element 61. The second control valve 60 differs from the first control valve 10 as will be described below, while the same structural elements are defined with the same reference numerals. The rotation preventing element 61 has another coupling piece 62 with a single projection 63 which engages in a corresponding single longitudinal groove 64 on a piston portion 65 of the main control slider 13. The projection 33 and the outer longitudinal groove 38 are arranged on the coupling part 62 in the same plane diametrically opposite to one another. The operation of the rotation preventing element 61 and the second control valve 60 corresponds to the operation of the rotation preventing element 46 in the first control valve 10.

Figure 7:
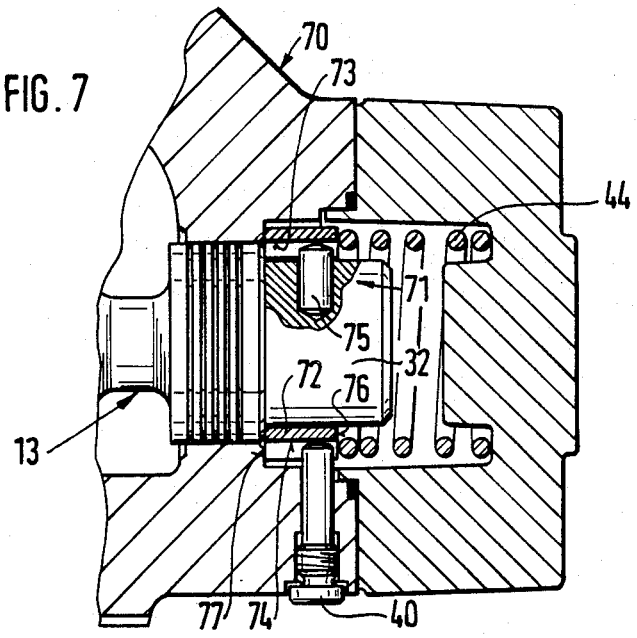
FIG. 7 is a view showing a partial longitudinal section of a third embodiment of the hydraulic control valve in accordance with the present invention.

FIG. 7 shows a third embodiment of a third control valve 70 which is shown partially in a longitudinal section and has another rotation preventing element 71. The third control valve 70 differs from the first control valve 10 as will be explained hereinbelow, while the same structural elements are identified with the same reference numerals. A rotation preventing element 71 utilizes as a coupling part a simple ring 72 which is guided on the piston portion 32 and provided on its inner diameter with an inner longitudinal groove 73 and on its outer diameter a diametrically opposite outer longitudinal groove 74. While the housing-fixed collar screw 40 engages in the outer longitudinal groove 74 a pin 75 which is radially mounted on the piston portion 32 engages in the inner longitudinal groove 73. The ring 72 has further mutually parallel flat end surfaces 76 and 77. The second spring 44 abuts against the end surfaces on the one hand, and the housing-fixed abutment 42, and/or the main control slider 13 abuts against them on the other hand.

The operation of the rotation preventing element 71 of the third control valve 70 corresponds to the operation of the first rotation preventing element 46. The ring 32 permits an extremely simple and price favorable construction. With the rotation preventing element 71, similarly to the rotation preventing elements 46 and 61, it can be achieved that by the angular arrangement of the control notch 19 to the pressure medium chambers 14–18 an optimal throughflow can be obtained. Since the pressure medium chambers 14–18 with the associated connecting channels are not formed in a rotation-symmetrical manner, low throughflow deviations are produced when the control notches 19 are arranged on the main control slider 13 at a desired tested rotary position.

The rotation preventing elements 46, 61, 71 perform therefore a triple function. In addition to the spring centering of the control slider 13, they prevent its rotation and also secure a favorable rotary position of the control notches 19 for the throughflow optimization.

It is to be understood that it is possible that the control valves with their rotation preventing elements can be modified. Thus, instead of the shown pin, also an adjusting spring or a similar structural element can be used as a guiding part. Also, a slot-pin connection for the rotation preventing element can be used.

It will be understood that each of the elements described above, or two or more together, may also find a useful application in other types of constructions differing from the types described above.

While the invention has been illustrated and described as embodied in a hydraulic control valve, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic control valve, comprising, a housing having a slider opening and at least two pressure medium chambers, a control member having two opposite ends and being formed as a pre-controlled main control slider provided with a plurality of control notches, said control member having an end portion which is formed as a piston portion and has a smaller diameter than the diameter of the remaining part of said control member; a return unit associated with said control member and having a spring plate; a rotation preventing element provided on one of said ends of said control member; a one-piece integral coupling part which is arranged on said control member non-rotatably and longitudinally displaceably relative to the latter, said copuling part being guided on said piston portion of said control member and provided with an abutment for said control member, said coupling part being formed as a sleeve-shaped part with a stepped throughgoing opening having an end side with a small diameter and two parallel cuts which form a guiding part in form of two projections, and with an inner opening portion having a greater diameter and opening toward said cuts for guiding on a control member; an abutment fixed on said housing; a return spring which presses said coupling part against said abutment of said housing; a structural member which is arranged radially to said control member so as to guide said coupling part longitudinally displaceably and non-rotatable relative to said housing; means for nonrotatably connecting said piston portion with said coupling part and including longitudinal groove means provided on said piston portion for receiving said guiding part; and means for non-rotatably connecting said coupling part with said housing and including a further longitudinal groove provided on an outer periphery of said coupling part and formed so that said structural member, engages in said further longitudinal groove, said structural member being fixed with an extending radially to said housing.

2. A control valve as defined in claim 1, wherein said control member has a control section which controls the communication between said pressure medium chambers.

3. A hydraulic control valve as defined in claim 1, wherein said piston portion has said at least one longitudinal groove, said coupling part being provided with at least one projection engaging in said longitudinal groove.

4. A hydraulic control valve as defined in claim 3, wherein said piston portion has two such longitudinal grooves which are arranged diametrically opposite to one another, said coupling part being provided with two such projections which engage in said two longitudinal grooves.

5. A hydraulic control valve, comprising, a housing having a slider opening and at least two pressure medium chambers, a control member having two opposite ends and being formed as a pre-controlled main control slider provided with a plurality of control notches, said control member having an end portion which is formed as a piston portion and has a smaller diameter than the diameter of the remaining part of said control member; a return unit associated with said control member and having a spring plate; a rotation preventing element provided on one of said ends of said control member; a one-piece integral coupling part which is arranged on said control member non-rotatably and longitudinally displaceably relative to the latter, said coupling part being guided on said piston portion of said control member and provided with an abutment for said control member, said coupling part being formed as a ring of said return unit and having an inner surface provided with an inner longitudinal groove and an outer surface provided with an outer longitudinal groove, said ring having two end surfaces which extend parallel to one another; an abutment fixed on said housing; a return spring which presses said coupling part against said abutment of said housing; a structural member which is arranged radially to said control member so as to guide said coupling part longitudinally displaceably and non-rotatable relative to said housing; means for non-rotatably connecting said piston portion with said coupling part and including said inner longitudinal groove on said coupling part and an associated guiding part provided in said piston portion; and means for non-rotatably connecting said coupling part with said housing and including said outer longitudinal groove provided on an outer periphery of said coupling part and formed so that said structural member engages in said outer longitudinal groove, said structural member being fixed with and extending radially to said housing.

6. A hydraulic control valve as defined in claim 5, wherein said inner longitudinal groove and said outer longitudinal groove of said ring are arranged at diametrically opposite locations.

7. A hydraulic control valve as defined in claim 1, wherein said structural element is formed as a collar screw, said coupling part having a portion provided with said outer longitudinal groove for said collar screw.

8. A hydraulic control valve as defined in claim 7, wherein said guiding part is provided on said portion of said control member is formed as a pin.

* * * * *